US007234289B2

(12) United States Patent
Hannen et al.

(10) Patent No.: US 7,234,289 B2
(45) Date of Patent: Jun. 26, 2007

(54) METHOD OF FITTING A PACKAGING HOOD OVER A LOAD

(75) Inventors: Reiner Hannen, Kalkar-Wissel (DE); Norbert Vermeulen, Kleve-Warbeyen (DE)

(73) Assignee: MSK-Verpackungs-Systeme Gesellschaft Mit Beschrankter Haftung, Kleve (DE)

( * ) Notice: Subject to any disclaimer, the term of this patent is extended or adjusted under 35 U.S.C. 154(b) by 13 days.

(21) Appl. No.: 10/511,920

(22) PCT Filed: Apr. 17, 2003

(86) PCT No.: PCT/EP03/04065

§ 371 (c)(1),
(2), (4) Date: Oct. 18, 2004

(87) PCT Pub. No.: WO03/089303

PCT Pub. Date: Oct. 30, 2003

(65) Prior Publication Data

US 2005/0115206 A1 Jun. 2, 2005

(30) Foreign Application Priority Data

Apr. 19, 2002 (DE) ..... 202 06 245
Apr. 19, 2002 (DE) ..... 202 06 246

(51) Int. Cl.
*B65B 53/00* (2006.01)

(52) U.S. Cl. ..... 53/441; 53/556

(58) Field of Classification Search ..... 53/441, 53/459, 556, 567, 577, 576, 397, 449
See application file for complete search history.

(56) References Cited

U.S. PATENT DOCUMENTS

| | | | | | |
|---|---|---|---|---|---|
| 3,707,064 | A | * | 12/1972 | Mucka et al. | 53/567 |
| 3,925,964 | A | * | 12/1975 | Birkenfeld et al. | 53/567 |
| 3,961,459 | A | * | 6/1976 | Wolske | 53/436 |
| 4,063,401 | A | * | 12/1977 | Higgins | 53/567 |
| 4,064,678 | A | * | 12/1977 | Grocke | 53/567 |
| 4,473,990 | A | * | 10/1984 | Thimon | 53/567 |
| 4,546,598 | A | * | 10/1985 | Karpisek | 53/556 |
| 4,724,658 | A | * | 2/1988 | Birkenfeld et al. | 53/557 |
| 5,247,783 | A | * | 9/1993 | Hannen | 53/567 |
| 6,032,439 | A | * | 3/2000 | Birkenfeld et al. | 53/441 |
| 6,470,654 | B1 | * | 10/2002 | Lachenmeier et al. | 53/567 |
| 6,662,535 | B2 | * | 12/2003 | Pin | 53/556 |

FOREIGN PATENT DOCUMENTS

| | | | |
|---|---|---|---|
| DE | 90 01 319 | * | 5/1990 |
| EP | 1 013 549 | | 6/2000 |

* cited by examiner

*Primary Examiner*—Rinaldi I. Rada
*Assistant Examiner*—Paul Durand
(74) *Attorney, Agent, or Firm*—Andew Wilford

(57) ABSTRACT

A foil hood is gathered into a stack of folds and then fitted over four fingers in inner positions of the fingers with the hood open downward. A holding device then clamps the hood against the fingers, the fingers are spread into outer positions to transversely stretch the hood, and then the holding device is disengaged. Finally the fingers are moved downward along the load such that the closed end of the hood engages on the top of the load and the hood is pulled upward fold-by-fold off the fingers through a predetermined position at which generally all of the folds have been pulled off the fingers to an end position at which the hood is stretched vertically over the load and all of the folds have been pulled off the fingers.

8 Claims, 2 Drawing Sheets

METHOD OF FITTING A PACKAGING HOOD OVER A LOAD

CROSS REFERENCE TO RELATED APPLICATIONS

This application is the US national phase of PCT application PCT/EP03/04065, filed 17 Apr. 2003, published 30 Oct. 2003 as WO 03/089303, and claiming the priority of German patent application 20206246.5 itself filed 19 Apr. 2002 and German patent application 20206245.7 itself filed 19 Apr. 2002.

FIELD OF THE INVENTION

The invention relates to an apparatus for wrapping a one- or multi-part load with at least one elastic foil hood that is gathered into folds and stretched and subsequently pulled over the one- or multi-part load, the gathered foil hood being stretched and pulled down by means of a pull-down device movable along the one- or multi-part load, and whereby the pull-down device has four tensioning fingers that are movable in planes perpendicular to a pull-down direction and that each have a bow-shaped tensioning element lying in this plane and, secured to it, a bow-shaped brace element extending generally in the pull-down direction in order to be able to take on the gathered foil hood in the respective corners of the one- or multi-part load to be wrapped and to pull it down over the one- or multi-part load.

BACKGROUND OF THE INVENTION

In one type of the known apparatus for wrapping, the folding of the foil that is normally closed at one end is effected by gathering right on the pull-down device. The pull-down device has spreadable tensioning corners, whereby preferably in each corner region of the pull-down device there is a respective gathering roller and an opposite counter roller paired together and both rotatable about horizontal axes. After engagement of the pull-down device into the foil hood, the foil hood is tensioned between the counter rollers and the gathering rollers and the gathering rollers are rotated to form the folds. After the fold-formation the tensioning corners are spread apart so that the foil hood is stretched so that it can subsequently be drawn over the one- or multi-part load. To this end the pull-down device is dropped over the one- or multi-part load so that the foil hood engages the top of the one- or multi-part load and is thus stopped. During downward movement the folds that run around the foil hood are progressively pulled off so that then the pull-down device reaches its lowermost position, the entire foil hood has no more folds and the one- or multi-part load and if necessary the underlying pallet are wrapped.

In order to avoid that during stretching of the foil hood it is pulled off the tensioning corners, it is gripped between the gathering wheels and the counter rolls. The disadvantage of this is that the foil hood is only held in a very limited region so that the foil hood can only be sufficiently stretched at its upper region, as otherwise the foil hood would be damaged.

In another type of the known apparatus there is a gathering device separate from the pull-down device. The foil hood is gathered by the gathering device and then is taken over by a separate movable pull-down device. The pull-down device has in the corner regions rod-shaped holding elements directed in the pull-down direction and serving to hold the gathered foil hood taken over from the gathering device. The foil hood is subsequently stretched by spreading of the holding elements and the pull-down device is shifted downward along the one- or multi-part load for pulling-down. The disadvantage of this is that during stretching the foil hood is not solidly gripped so that the foil hood cannot be sufficiently stretched since it would slip partly off the holding elements.

OBJECT OF THE INVENTION

It is an object of the invention to improve on an apparatus as described above so that the upper region of the foil hood can be stretched more.

SUMMARY OF THE INVENTION

This object is attained in that at least one of the tensioning fingers is provided with a jaw-like holding device that is engageable shortly before reaching an end position externally at least partially around in the region of last fold to be pulled over the one- or multi-part load shortly before reaching the pull-down position, in particular in the unfolded region of the foil hood adjacent this fold, and that clamp the regions of the foil hood to the tensioning fingers during stretching. Before stretching, the holding device is engaged from outside at least in the region of the one- or multi-part load before the pull-down device reaches its lowermost position on the uppermost fold to be drawn over the one- or multi-part load, in particular on the unfolded region adjacent this fold, so that the foil hood is held solidly between the holding device and the tensioning finger. In this manner the foil hood can be more greatly stretched in the head top region.

Since stretching in the pull-down direction on the one- or multi-part load of nearly the entire foil hood and if necessary stretching in the pull-down direction is desired, the holding devices can be pressed inwardly preferably against the folds not yet pulled off the tensioning fingers and down over the one- or multi-part load. This holding in the region of the open end of the foil hood stretches the foil hood more in the pull-down direction when it is nearly fully installed and tightens it.

Preferably there is one such holding device on two diagonally opposed tensioning fingers. It is also perfectly possible to provide one such holding device on each tensioning finger.

The holding device has a shape corresponding generally to an outside surface of the respective tensioning finger in a contact region between the tensioning finger and the holding device. In this manner the maximum surface is gripped between the holding device and its tensioning finger so that considerable stretch can be imparted in the top region. At the same time the foil hood can be more tightly stretched or tensioned in the pull-down direction shortly before the end of the pull-down operation.

The surface of the holding device engageable with the foil hood can be arcuate.

The holding device can be movable in a plane perpendicular to the pull-down direction.

The holding device can be displaceable by a pivotal positioning lever in the direction of the respective tensioning finger. To this end for example guide slides can be provided that permit movement parallel to two adjacent side faces of the one- or multi-part load. It is also however possible that the holding devices move purely in straight lines or in a combination of the two movements.

The holding device can be displaced by a pivotal positioning lever in the direction of the respective tensioning finger. Here it is preferable that the holding device be pivotal on the positioning lever so that the holding device can fit optimally with the outside surface of the tensioning finger. It is also preferable when the holding device is only limitedly pivotal relative to its positioning lever in order to avoid that when the holding device is moved toward its tensioning finger it gets canted and does not engage with its surface against the foil hood. The positioning lever can for example be moved hydraulically or pneumatically. Other drives as, for example, electrical, are possible.

In order to increase the holding effect at least surfaces of the holding device engageable with the foil hood have a friction-increasing surface.

The surface can have a friction-increasing coating.

In order to avoid damage to the foil hood, the surface has a soft coating, in particular sponge rubber.

It is also perfectly possible for the surface to have alternating raised and recessed regions.

So long as the pull-down device is provided only for pulling down and stretching, a separate gathering device is provided for independent gathering. The subsequent stretching of the foil hood and pulling it down over the one- or multi-part load takes place separately from the gathering device by the pull-down device movable separate from the gathering device along the one- or multi-part load. In this manner it is possible that the gathering device can be stretching another hood while the previous hood is being pulled down over the one- or multi-part load.

Preferably surfaces of the holding device engageable with the foil hood correspond to the minimal contact surface needed to avoid damaging the foil hood during stretching taking into account the technical features and characteristics of the foil hood as well as the amount of stretch. The "technical features" and characteristics are for example the thickness, the elasticity, and the stretchability of the foil hood that influence the minimal necessary holding surface in order to avoid damage. Under some circumstances also the shape, the size, or the composition of the one- or multi-part load influences the size of the minimal necessary holding surface.

An object of the invention is also a method of wrapping a one- or multi-part load with at least one elastic foil hood that is gathered into folds and stretched and subsequently pulled over the one- or multi-part load, the gathered foil hood being stretched and pulled down by means of a pull-down device movable along the one- or multi-part load, and whereby the pull-down device has four tensioning fingers that are movable in planes perpendicular to a pull-down direction and that each have a bow-shaped tensioning element lying in this plane and, secured to it, a bow-shaped brace element extending generally in the pull-down direction in order to be able to take on the gathered foil hood in the respective corners of the one- or multi-part load to be wrapped and to pull it down over the one- or multi-part load.

The disadvantage of this known method is that the foil hood is not sufficiently stretched before being pulled down in the head region, that is in the region farthest from the one- or multi-part load only shortly before reaching the bottom reversing position, since the foil hood can come loose in this region during stretching by the tensioning fingers.

It is thus another object of the invention to provide an improved method whereby the head region of the foil hood is stretched more.

This object is attained in that at least one of the tensioning fingers is provided with a jaw-like holding device that is engageable shortly before reaching an end position externally at least partially around in the region of the last fold to be pulled over the one- or multi-part load shortly before reaching the pull-down position, in particular in the unfolded region of the foil hood adjacent this fold, and that clamp the regions of the foil hood to the tensioning fingers during stretching, at least one holding device being pressed with the respective tensioning finger against the foil hood before stretching of the foil hood and being separated from the foil hood after contact of the foil hood with the one- or multi-part load. The clamping action prevents the foil hood from coming unintentionally off the clamping fingers during stretching so that it is possible to impart considerable stretch.

Preferably at least one holding device is brought back against the respective tensioning finger to hold the foil hood after pulling-off of the folds shortly before separation of the foil hood from the holding device. Pressing the holding device back against the tensioning fingers shortly before the end of the pull-down operation stretches the foil hood in the pull-down direction and, if desired, also tensions it, so that considerable vertical stretch can be imparted. Afterward the holding devices are again pulled off the foil hood and the pull-down device is returned back up to its starting position.

An object of the invention is also a method of wrapping a one- or multi-part load with at least one elastic foil hood that is gathered into folds and stretched and subsequently pulled over the one- or multi-part load, the gathered foil hood being stretched and pulled down by means of a pull-down device movable along the one- or multi-part load, the pull-down device having four tensioning fingers that are movable in planes perpendicular to a pull-down direction and that each have a bow-shaped tensioning element lying in this plane and, secured to it, a bow-shaped brace element extending generally in the pull-down direction in order to be able to take on the gathered foil hood in the respective corners of the one- or multi-part load to be wrapped and to pull it down over the one- or multi-part load.

In order that the gathered and stretched foil hood can be pulled over the one- or multi-part load easily and without damage, the foil hood is gathered like a bellows. After the gathering operation the folds should be oriented pointing downward and outward toward the one- or multi-part load to be wrapped. Only this uniform orientation of the folds ensures a subsequent problem-free pulling-off of the foil hood, since then the folds will be pulled one at time from the pull-down device.

A disadvantage of the known method is that the folds are not always oriented perfectly uniformly. More often the folds are in some places more or less randomly oriented. The uncontrolled formation of folds can take place during the gathering operation or even during stretching.

When the folds do not have the desired orientation, the next fold to be pulled off in the next step is partially if not completely covered and thus held and retained by the adjacent fold. This condition can lead to damaging of the foil hood and holes can be formed in the foil hood. This danger is particularly great with very thin foil hoods since then the foil is easily ripped when being pulled or with a one- or multi-part load of great height since a longer foil hood must be gathered and there are more folds.

It is an object of the invention to improve on the above-described method in that during the pull-down operation even with nonoptimal folds damage to the foil hood is avoided.

This object is attained in that the gathered foil hood to be pulled down over the one- or multi-part load in a first step is stretched to a first great amount and in a second step the stretching of the foil hood during the pull-down operation of the gathered foil hood over the one- or multi-part load is reduced somewhat but still maintained enough to permit the pulling down.

Thus the foil hood is initially in the first step stretched much more than would normally be done by the standard method. Prior-art stretching is normally kept as small as possible and is set for the minimum necessary for carrying out the method. In order to achieve this minimal stretching with the know method the foil hood is only stretched enough to produce clearance of 3 to 5 cm on all sides between the one- or multi-part load and the foil hood.

According to the method of this invention the foil hood is first stretched so much in a first step that a clearance of 6 to 10 cm is produced on all sides between the one- or multi-part load and the foil hood. More stretching is even possible.

As a result of the subsequent reduction of stretching of the foil hood in a second step during the pull-down operation—created by moving apart parts of the pull-down device, normally the tensioning fingers—the tension in the folds of the gather foil hood are reduced so that the folds, in particular those that are not properly oriented, do not retain the adjacent foils so that the foil hood can be pulled down without damage and in a problem-free manner.

Here the tension reduction to an at least partially reduced lower setting with correspondingly resulting reduced setting, which is above the minimal resulting and/or the reduced setting corresponding to no holding force at all, is determined by the time offset with which the tension reduction takes place.

The higher level of stretching is thus above the tolerance range at the lower level and is as a result substantially greater than the tension at the lower level. The level of the lower tension that corresponds to the least stretching is determined not only by the geometry of the one- or multi-part load. Other parameters also, such as for example the dimensions of the parts of the pull-down apparatus inside the foil hood, influence the amount of the lower level of stretching.

The reduction of stretching to the lower level can start with the first contact of the foil with the top of the one- or multi-part load or at a later point during the pull-down operation.

In one possible embodiment of the invention the reduction of stretching is effected during the pull-down operation of the foil hood over the one- or multi-part load continuously, in particular uniformly.

Alternatively the reduction of stretching is effected during the pull-down operation of the foil hood over the one- or multi-part load in steps, in particular in multiple steps. With a one-step reduction the complete pull-down operation is completed before the reduction is completed and the foil hood is reduced to the lower level of stretch.

When the one- or multi-part load to be wrapped is particularly tall, there is the danger that before the pull-down operation is complete the tension reduction is completed and the foil hood has reached the level of minimal stretch. In this case it is preferred that the reduction take place in multiple steps.

The reduction of stretching can take place during the first third of the pull-down operation. The pull-down operation thus starts with contacting of the foil hood with the top of the one- or multi-part load.

Preferably the reduction of stretching is effected at a spacing of 5 to 20 cm above the one- or multi-part load, preferably at 10 cm above the top of the one- or multi-part load.

Preferably the foil hood stretched to a great amount in the first step is at the start of the pull-down operation held by at least one holding device and the holding device is separated from the foil hood in the second step with reduction of the stretching to a reduced amount. During the pull-down operation of the foil hood, the foil hood that is highly stretched in the first step is gripped. As a result the foil hood only engages the top of the one- or multi-part load, while the sides of the one- or multi-part load do not touch the foil hood. Holding creates vertical tensions in the foil hood. Later during the pull-down operation in the second step the stretch is reduced to a lower level and the holding device is detached from the foil hood, so that the foil hood can be pulled off one fold at a time.

BRIEF DESCRIPTION OF THE DRAWING

An embodiment of the invention shown in the drawing. Therein.

SPECIFIC DESCRIPTION

In all the figures the same references are applied to the same or similar parts.

Figure 1:
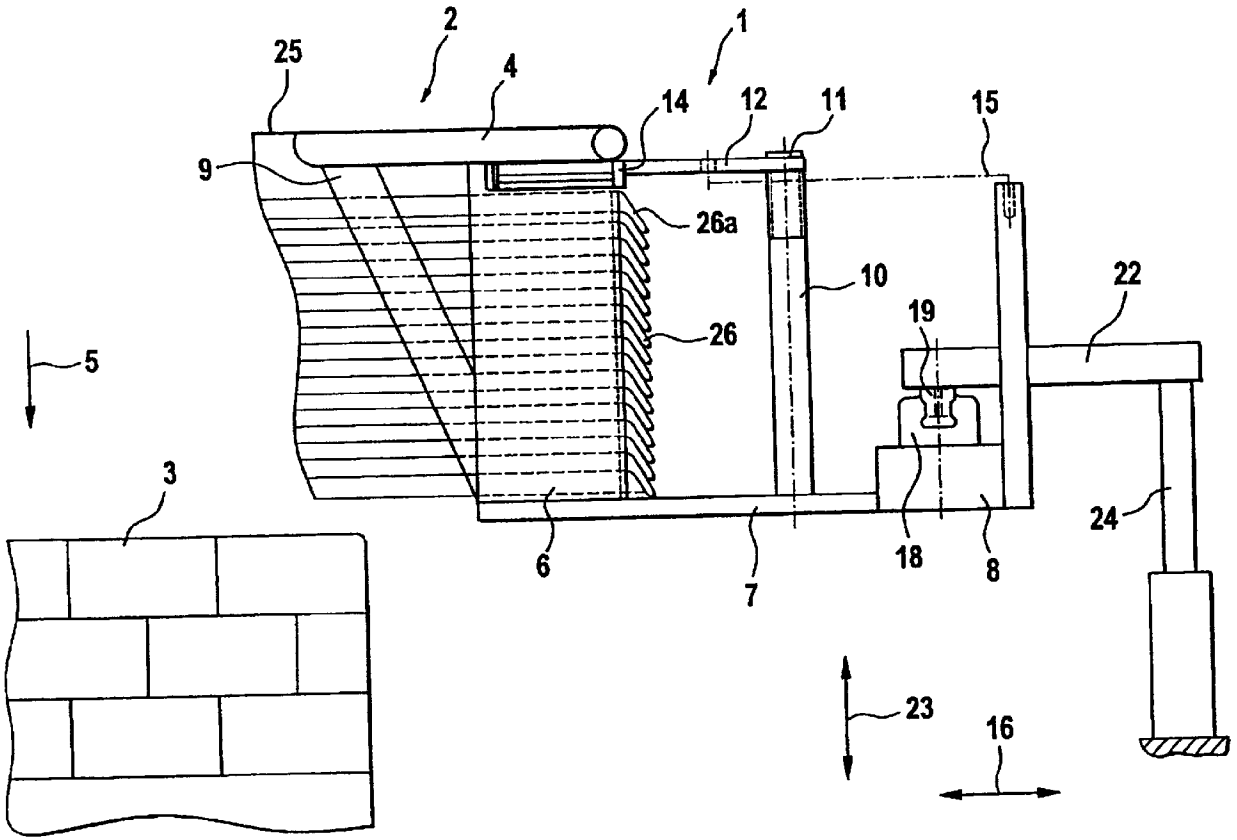
FIG. 1 is a side view of a tensioning finger with a foil portion gathered on it.
Figure 2:
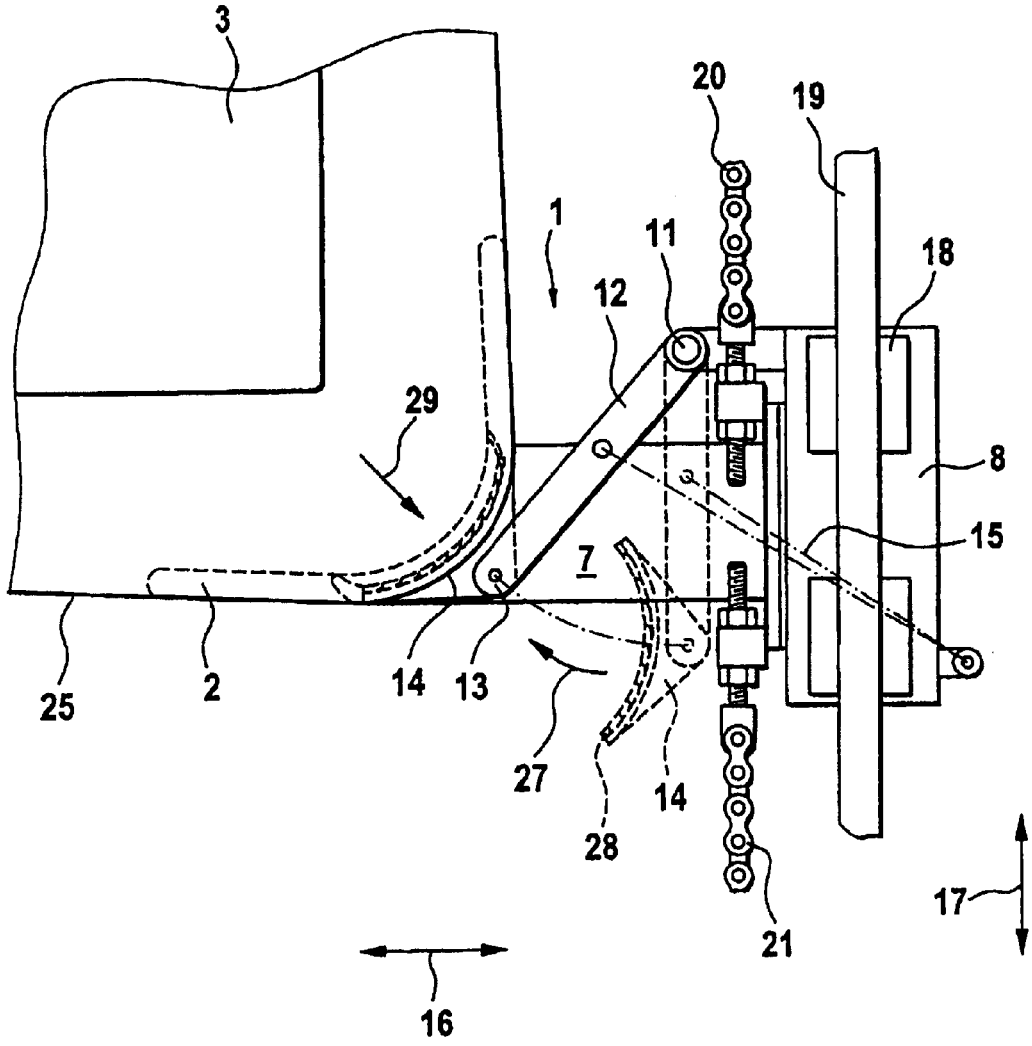
FIG. 2 is a partial top view of the structure of FIG. 1.

FIGS. 1 and 2 show a pull-down device 1 of an apparatus according to the invention. An upstream gathering device is not shown. The pull-down device 1 has four tensioning fingers 2 that are arranged in respective corners of a partially shown one- or multi-part load 3 to be packed.

Each tensioning finger 2 is comprised of an arcuately shaped tubular tensioning element 4 that is oriented in a plane extending perpendicular to a pull-down direction 5.

Each tensioning element 4 is carried on an L-shaped brace element 6 that is secured at its lower end to a traverse 7 of a mount 8.

As visible in FIG. 1, both ends of the tensioning element 4 are connected via a respective strut 9 with the brace element 6.

A mast 10 projects upward from the traverse 7. A bearing 11 on this mast 10 supports a positioning lever 12 whose free end carries a holding device 14 via another bearing 13. A face of the holding device 14 engageable with the tensioning finger 2 is shaped the same as the outside of the tensioning finger 2. Since the brace element 6 of the tensioning finger 2 in the illustrated embodiment is somewhat arcuate, the holding device 14 has a corresponding arcuate shape. It is however perfectly possible that the tensioning finger 2 be provided level with the tensioning element 4.

The positioning lever 12 is engaged by a cylinder 15 that is shown in dot-dash lines in the drawing. This can for example be a pneumatic or hydraulic cylinder.

As shown in particular in FIG. 2 the tensioning finger 2 and also the holding device 14 mounted with it on the traverse 7 are movable along the longitudinal faces of the one- or multi-part load 3 (arrows 16 and 17). For the movement in the direction of arrow 17, the mount 8 is supported via guides 18 on a guide rail 19. Chains 20 and 21 engaging the traverse 7 can move the tensioning finger 2 in the direction of the arrow 17.

The guide rail 19 is engaged at its upper end in a support 22 such that the pull-down device 1 can move in the direction of the arrow 16. The exact construction making movement in the direction of the arrow 16 possible is not shown for the sake of clarity of view.

In order that each pull-down device 1 can move in the direction of arrow 23 along the one- or multi-part load 3, there is in the illustrated embodiment a hydraulic cylinder 24 engaging underneath the support 22. Other systems for movement in the direction of the arrow 23 are possible.

As shown in the drawing, the four tensioning fingers 2 are engaged in a downwardly open foil hood 25. The foil hood 25 is already gathered into folds 26 on the fingers 2. The gathering itself is done in an unillustrated separate gathering device. The foil hood 25 is pulled from the gathering device in gathered condition by the illustrated pull-down devices 1.

After taking on the gathered foil hood 25 each holding device 14 is pivoted in the direction of arrow 27 toward the respective tensioning finger 2 so that the foil hood 25 is clamped between the brace 6 of the tensioning finger and the respective holding device 14. In order to avoid damage to the foil hood 25, the surfaces engaging the foil hood 25 of the holding device 14 have a soft coating 28, e.g. sponge rubber. Other coverings are possible.

After engagement of the holding devices 14 the tensioning fingers 2 are moved outward, for example diagonally apart as shown by arrow 29 so that the foil hood 25 is stretched. The clamping of the foil 25 at its upper region, in this case at its closed end, ensures optimal stretching.

After stretching, the pull-down device 1 is moved in the pull-down direction 5 along the one- or multi-part load 3. As soon as the closed top of the foil hood 25 engages the top of the one- or multi-part load 3 the holding devices 14 are moved into the positions illustrated in FIG. 2 in dashed lines. With further dropping of the pull-down device 1 the folds 26 are progressively pulled off the tensioning fingers 2 so that, when the pull-down device 1 reaches its lowermost position, the entire foil hood 25 has no more folds 26 and surrounds the one- or multi-part load 3.

To then tension and if necessary stretch the foil hood 25 in the pull-down direction 5, shortly before the foil hood 25 is completely pulled off the tensioning fingers 2 the holding devices 14 are moved back into their FIG. 2 solid-line positions so that the foil hood 25 is again clamped between the holding devices 14 and the respective tensioning fingers 2.

In this manner the foil hood 25 can be optimally tensioned and stretched in the pull-down direction 5.

After tensioning and if necessary stretching in the pull-down direction 54, the holding devices 14 are swung back and the pull-down device is moved back opposite the pull-down direction 5 into its original position shown in FIG. 1 in order to take on another gathered foil hood 25.

If the folds 26 do not form the uniform downward and outward array shown in FIG. 1 after gathering, for a damage-free drawing-off of the foil hood 25 from the tensioning fingers 2 it is necessary that the gathered foil hood 25 be stretched to a considerable extent in a first step for drawing it over the one- or multi-part load 3 and in a second step the stretching of the foil hood 25 during the actual drawing-down step of the gathered foil hood 25 over the one- or multi-part load 3 is reduced somewhat while still permitting it to be pulled down.

In this manner the foil hood 25 is greatly stretched in the first step so that in this greatly stretched condition a good gap of some 6 to 20 cm is formed between each face of the one- or multi-part load 3 and the greatly stretched foil 25. More stretching is however perfectly possible.

As a result of the subsequent reduction of the stretching of the foil hood 25 in the second step during drawing down, the movement of the tensioning fingers 2 along the edges of the one- or multi-part load 3 (arrows 16 and 17) reduces the tension in the folds 26 of the gathered foil hood 25 so that the folds 26 are not so greatly clamped by the adjacent folds 26 and held with the result that the foil hood 25 can be pulled down without damage or problems.

The reduction of the stretching can take place continuously or in steps, in particular in multiple steps.

In order to produce both the great or higher stretch in the first step and the lesser (minimal) stretch in the second step in one embodiment one and the same part, e.g. a drive motor, can be used that is correspondingly controlled.

Of course it is also possible to use two separate drives as, for example, two motors or hydraulic cylinders with the one drive producing the low stretch and the other second drive producing the larger high stretch.

The invention claimed is:

1. A method of wrapping a foil hood with an open end and a closed end around a load having a top and a plurality of vertical sides meeting at vertically extending corners, the method comprising the steps of sequentially;

positioning a respective tensioning finger immediately adjacent each of the corners in an inner position above the load;

gathering the hood into a plurality of vertically stacked folds and fitting the gathered hood over the fingers in the inner positions of the fingers with the open end of the hood open downward;

spreading the fingers outward away from the load into outer positions spaced from the load and thereby transversely stretching the hood; and thereafter simultaneously moving the fingers downward along the load such that the closed end of the hood engages on the top of the load and the hood is pulled upward fold-by-fold off the fingers and continuously displacing the fingers inward toward each other into intermediate positions lying outward of the inner positions and inward of the outer positions.

2. The load-wrapping method defined in claim 1 wherein the fingers are moved downward to a predetermined position at which generally all of the folds have been pulled off the fingers, the method further comprising the steps of:

engaging a holding device against at least one of fingers to clamp the hood thereagainst when the predetermined position has been reached; and thereafter moving the fingers further downward with the hood clamped between the holding device and the one finger to vertically stretch the hood.

3. A method of wrapping a foil hood with an open end and a closed end around a load having a top and a plurality of vertical sides meeting at vertically extending corners, the method comprising the steps of sequentially;

a) positioning a respective tensioning finger immediately adjacent each of the corners in an inner position above the load;

b) gathering the hood into a plurality of vertically stacked folds and fitting the gathered hood over the fingers in the inner positions of the fingers with the open end of the hood open downward;

c) engaging a holding device against one of the fingers to clamp the hood thereagainst;

d) spreading the fingers outward away from the load into outer positions spaced from the load and thereby transversely stretching the hood while clamping the hood with the holding device;

e) disengaging the holding device and thereby unclamping the hood; and f) moving the fingers downward along the load with the holding device out of engagement through the hood with the respective one of the fingers such that the closed end of the hood engages on the top of the load and the hood is pulled upward fold-by-fold off the fingers through a predetermined position at which generally all of the folds have been pulled off the fingers to an end position at which the hood is stretched vertically over the load and all of the folds have been pulled off the fingers.

4. The load-wrapping method defined in claim 3 further comprising the step during downward movement of the fingers of displacing the fingers inward into intermediate positions outward of the inner positions and inward of the outer positions.

5. The load-wrapping method defined in claim 4 wherein the fingers are moved continuously inward from the outer positions to the intermediate positions during downward movement of the fingers.

6. The load-wrapping method defined in claim 4 wherein the fingers are moved inward in at least one step from the outer positions to the intermediate positions during downward movement of the fingers.

7. The load-wrapping method defined in claim 3, further comprising the step after step e) and during step f) of:

once the predetermined position has been reached, engaging the holding device against the respective finger to clamp the hood thereagainst, whereby further downward of the fingers with the hood clamped between the holding device and the one finger vertically stretches the hood.

8. The load-wrapping method defined in claim 7 wherein each finger is provided with one such holding element and the holding elements are moved jointly into and out of engagement through the hood with the respective fingers.

* * * * *